US006179641B1

(12) United States Patent
Kaneko

(10) Patent No.: US 6,179,641 B1
(45) Date of Patent: Jan. 30, 2001

(54) ELECTRICAL CONNECTOR

(75) Inventor: Takeshi Kaneko, Tokyo (JP)

(73) Assignee: Hirose Electric Co., Ltd., Tokyo (JP)

( * ) Notice: Under 35 U.S.C. 154(b), the term of this patent shall be extended for 0 days.

(21) Appl. No.: 09/418,599

(22) Filed: Oct. 15, 1999

(30) Foreign Application Priority Data

Oct. 20, 1998 (JP) ..... 10-297679

(51) Int. Cl.[7] ..... H01R 13/627
(52) U.S. Cl. ..... 439/349; 439/352
(58) Field of Search ..... 439/349, 350, 439/352, 357, 345, 924

(56) References Cited

U.S. PATENT DOCUMENTS 4,927,374 * 5/1990 Batty ..... 439/352
5,176,533 * 1/1993 Sakurai et al. ..... 439/352
5,195,904 * 3/1993 Cyvoct ..... 439/349
5,997,333 * 12/1999 Konda et al. ..... 439/352

* cited by examiner

*Primary Examiner*—Hien Vu
(74) *Attorney, Agent, or Firm*—Kanesaka & Takeuchi

(57) ABSTRACT

An electrical connector system comprising an engaging device (34, 18) for engaging the fitting section (32) with the receiving section (16); and a releasing device (24, 19) for releasing the engaging means. The engaging device comprises a circumferential groove (33) provided in the fitting section (32); a resiliently expandable member (34) provided in the circumferential groove; a pressure portion (19) provided on a front inside of the receiving section (16) for abutment with the resiliently expandable member (34) upon plugging operation; and an engaging groove (18) provided in an inside of the receiving section for engagement with the resiliently expandable member (34).

4 Claims, 8 Drawing Sheets

ELECTRICAL CONNECTOR

BACKGROUND OF THE INVENTION

1. Field of the Invention

The present invention relates to electrical connectors and, more particularly, to a push-pull type electrical connector.

2. Description of the Related Art

FIG. 8 shows part of a conventional push-pull type electrical connector. A connector 50 comprises a housing body 51 having a front tubular section 52. A sleeve 54 is biased forwardly by a coil spring 53 along the tubular section 52. Circumferential projections 55 and 56 are provided at the front end and an end portion of the tubular section 52. A circumferential projection 57 is provided on the inside middle portion of the sleeve 54 to determine the most forward position of the sleeve 54 which is biased by the coil spring 53 and define an annular space 59 between the sleeve 54 and the tubular section 52. A circumferential recess 58 is provided on the inside front end of the sleeve 54 at a position corresponding to the circumferential projection 55 of the tubular section 52.

Another connector 60 comprises a housing body 61 having an outer tubular section 62 to form an annular receiving space 63 for receiving the tubular section 52 of the connector 50 while the outer tubular section 62 enters the annular space 59. The outer tubular section 62 has a pair of axial slits and a circumferential slit 64 to form a cantilevered flexible arm 65 which has an inward projection 66 at the front free end.

When the connector 60 is plugged into the connector 50 in the direction of an arrow in FIG. 8, the outer tubular section 62 enters the annular space 59 of the connector 50. The inward projection 66 of the flexible arm 65 is pushed outwardly by the circumferential projection 55 to flex the flexible arm 65, which pushes rearwardly the sleeve 54 at the shoulder of the circumferential recess 58 against the bias of the coil spring 53. When the inward projection 66 passes over and engages with the circumferential projection 55, the flexible arm 65 returns to the normal position. Then, the sleeve 54 returns to the front position so that even if the flexible arm 65 receives an external force in the radial direction, it cannot be flexed outwardly owing to the sleeve 54, thus locking the plugging of the connectors.

To separate the connectors, the sleeve 54 is pulled rearwardly against the coil spring 53 while the other connector 60 is pulled out of the connector 50.

However, the conventional connectors are too long in the plugging direction and difficult to handle. The flexible arm 65 of the other connector 60 must be sufficiently flexible to provide a predetermined amount of flexure. In order to assure engagement between the connectors 50 and 60, the engaging projections 55 and 66 must be large. In order that the inward projection 66 passes the circumferential projection 55, the flexible arm 65 must be long, leading to the long connectors 60 and 50.

Upon plugging, the sleeve 54 of the connector 50 must retreat to a large extent, which means that the operator cannot work by holding both the connectors 50 and 60 because if the operator holds the sleeve 54, the sleeve cannot retreat.

SUMMARY OF THE INVENTION

Accordingly, it is an object of the invention to provide an electrical connector which is compact and easy to handle.

The invention relates to an electrical connector system comprising a first connector comprising a first housing having a front tubular receiving section; a second connector comprising a second housing having a front tubular fitting section for fitting into the receiving section; an engaging device for engaging the fitting section with the receiving section; and a releasing device for releasing the engaging device.

According to the invention, the engaging device comprises a circumferential groove provided in the fitting section of the second connector; a resiliently expandable member provided on the circumferential groove; a pressure portion provided on a front inside of the receiving section of the first connector for abutment with the resiliently expandable member upon plugging operation; and an engaging groove provided in an inside of the receiving section of the first connector for engagement with the resiliently expandable member.

The release device comprises a spring provided in either the first housing or the second housing; a sleeve biased by the spring for sliding along either the receiving section or the fitting section; a release projection provided on an inside front end of the sleeve; and a tapered face provided on at least one of the release projection and the resiliently expandable member for permitting the release projection to ride on the resiliently expandable member when the sleeve is moved rearwardly.

Upon plugging, the pressure portion of the first connector compresses the resiliently expandable member of the second connector so that the second connector can pass the pressure portion of the first connector. When the resiliently expandable member reaches the engaging groove, it returns to the original form so that the connectors are connected via the resiliently expandable member.

To release the connection of the connectors, the sleeve is moved rearwardly so that the release projection rides on and compresses the resiliently expandable member. Consequently, the resiliently expandable member is released from the engaging groove so that the connectors can be separated.

According to the invention, it is preferred that the second connector further comprises a regulation piece extending to the circumferential groove for preventing excessive expansion of the resiliently expandable member, thereby assuring stable operation of the resiliently expandable member.

According to an embodiment of the invention, the resiliently expandable member is a C-shaped ring having a slit at a position in the circular direction.

According to another embodiment of the invention, the second connector further comprises a projecting piece for engagement with a notch of the C-shaped ring to prevent the C-shaped ring from shifting in the circumferential direction. For example, the regulation piece is placed at the slit to control deformation of the C-shaped ring.

DESCRIPTION OF THE PREFERRED EMBODIMENTS

Figure 1:
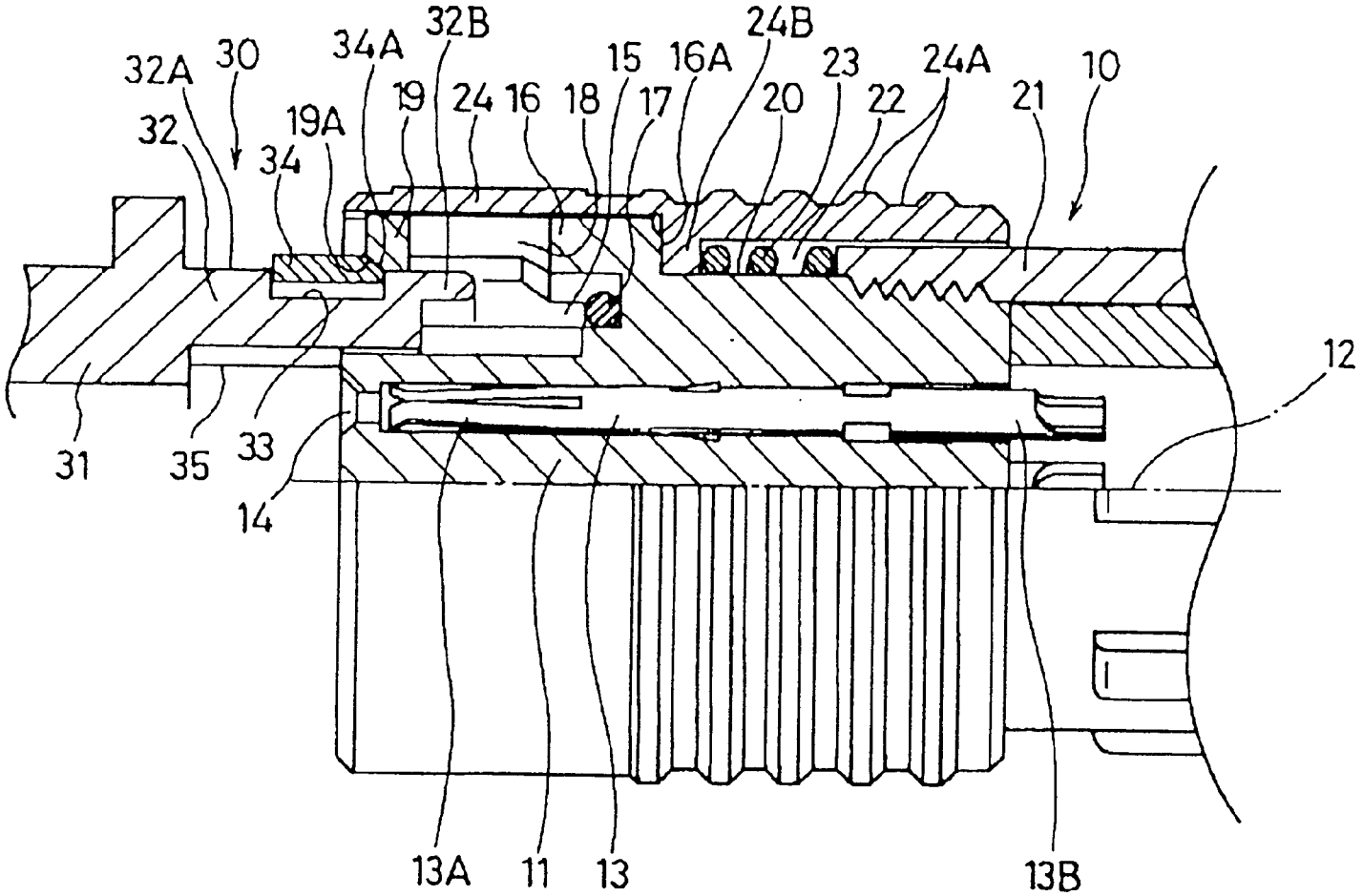
FIG. 1 is a side elevational, partially sectional, view of a pair of electrical connectors according to an embodiment of the invention.
Figure 2:
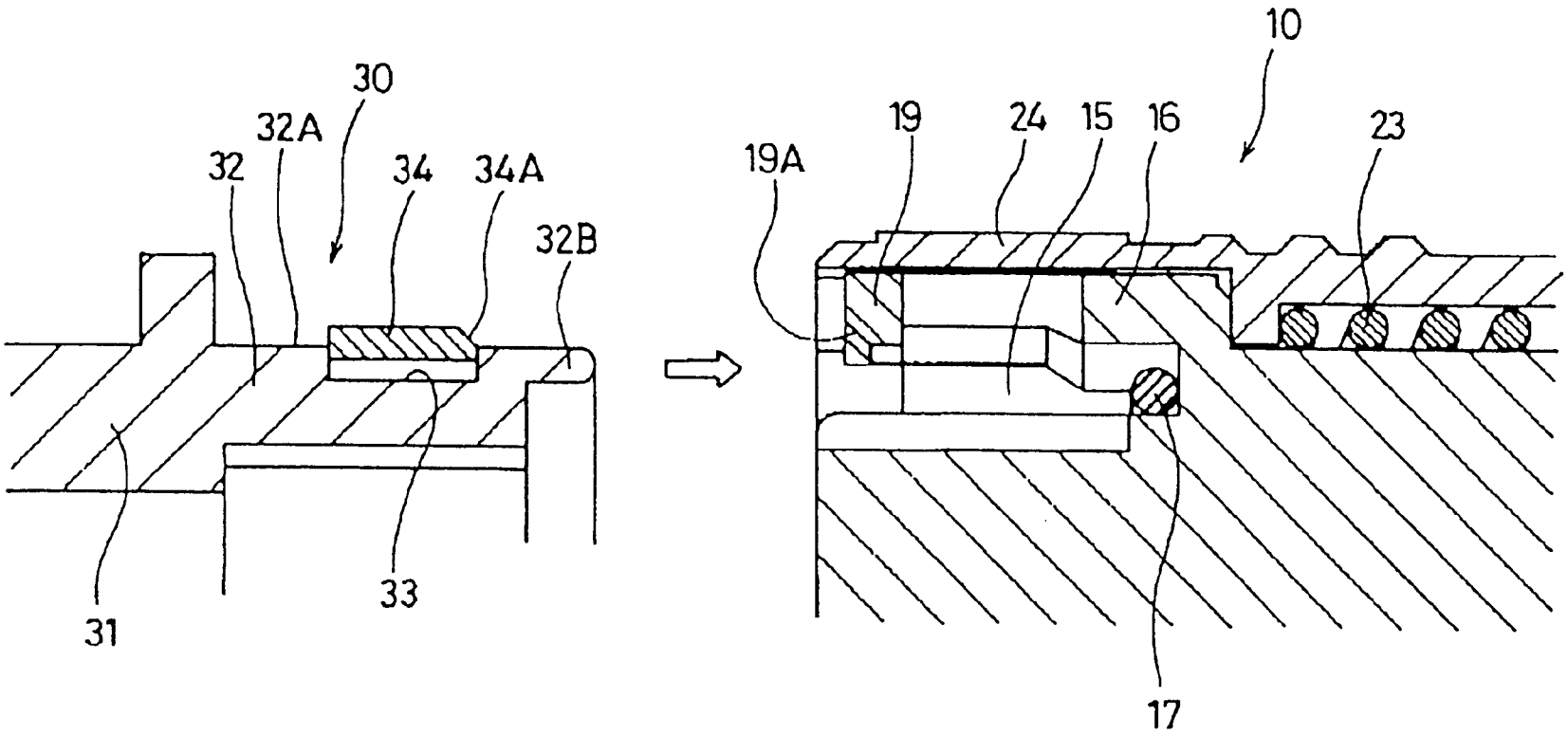
FIG. 2 is a sectional view of the electrical connectors prior to plugging.
Figure 3:
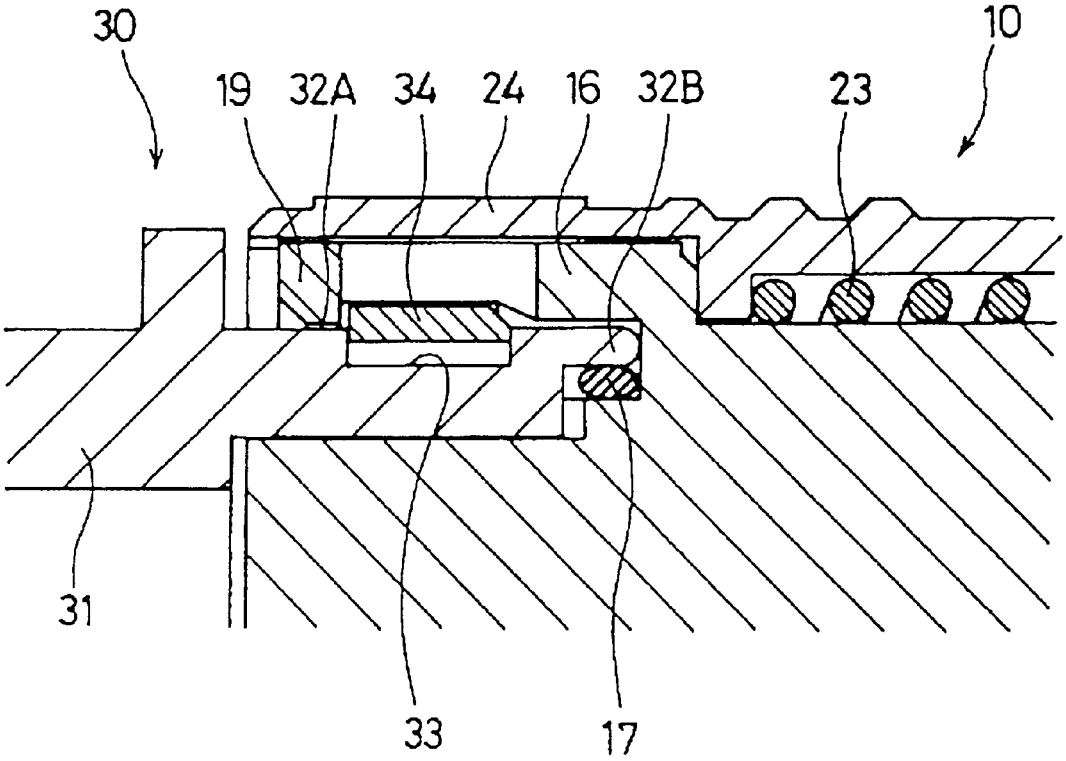
FIG. 3 is a sectional view of the electrical connectors which have been plugged.

Embodiments of the invention will now be described with reference to the accompanying drawings, wherein FIGS. 1–3 show, in section, a pair of electrical connectors which are being plugged, prior to plugging, and have been plugged, respectively.

A connector 10 is adapted to plug over another connector 30 for connection. The connector 10 comprises a tubular housing 11 made from an dielectric material around an axis 12 and a plurality of contact elements 13 extending in the tubular housing 11 in parallel to the axis 12. Each contact element 13 has at the front end a female contact section 13A adjacent to an opening 14 of the tubular housing 11 and at the rear end a connection section 13B extending through the tubular housing 11.

The tubular housing 11 has a receiving section 16 having a receiving space 15 with an opening at the front end. An O-ring 17 is provided at the rear end of the receiving space 15 for sealing. An engaging groove 18 is provided in the receiving section 16. A pressure portion 19 is provided on the inside front edge of the receiving section 16 in front of the engaging groove 18. The front edge 19A of the pressure portion 19 is tapered. The receiving section 16, the receiving space 15, the engaging groove 18, and the pressure portion 19 will be described in more detail relative to the other connector 30.

A small-diameter section 20 extends rearwardly from the receiving section 16 and has a threaded section at the rear portion to which a holding tube 21 is fixed. A coil spring 23 is provided in an annular space 22. A sleeve 24 is provided around the tubular housing 11. A corrugated surface 24A is provided on the sleeve 24 for facilitating a back-and-forth operation. A circumferential engaging projection 24B is provided at an inside middle portion of the sleeve 24. The sleeve 24 is biased forwardly by the coil spring 23 so that the engaging projection 24B abuts against the rear wall 16A of the receiving section 16. Also, it is guided by the tubular section 16 at the front portion and by the holding tubular body 21 at the rear portion.

The other connector 30 comprises an insulating housing 31 having a fitting or front tubular section 32 which has sufficient inside and outside diameters and length to be received by the receiving space 15 of the connector 10. An annular projection 32B extends forwardly from the tubular section 32 and has an inside diameter such that when the tubular section 32 enters the receiving space 15, it compresses the O-ring 17 in the receiving space 15 in the radial direction. The tubular section 32 has a fitting surface 32A which is fitted in the receiving section 16 of the connector 10.

A circumferential groove 33 is provided in the housing 31 for receiving a C-shaped ring 34 which is able to resiliently shrink and expand. Upon expanding, the C-shaped ring projects in the radial direction from the circumferential groove 33. The front outer corner 34A of the C-shaped ring 34 is tapered so that it abuts on the tapered front edge 19A of the pressure portion 19. That is, when the tubular section 32 enters the receiving space of the connector 10, the C-shaped ring 34 is compressed by the tapered face 19A permitting further advance of the tubular section 32. Upon passing the pressure portion 19, the C-shaped ring 34 returns to the original form or expands into and engages with the engaging groove 18 and, thus, is prevented from backward movement.

In this embodiment, the cavity 35 of the tubular section 32 receives the front section of the connector 10 upon plugging. However, the front ends of housings of both the connectors 10 and 30 may be made to abut against each other.

Figure 4A:
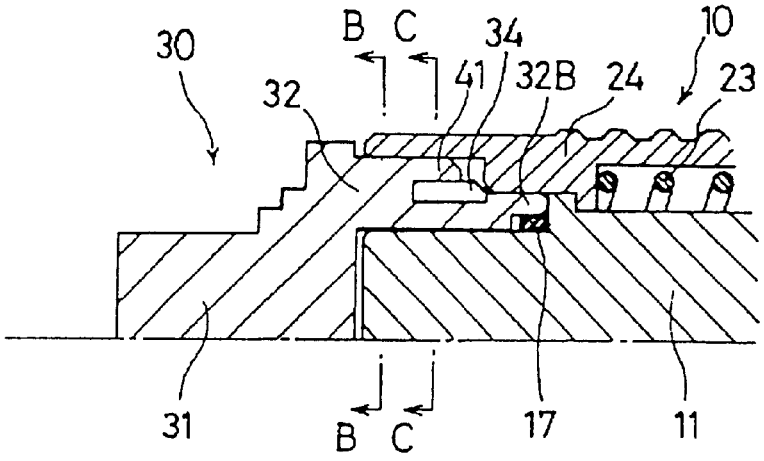
FIG. 4(A) is a sectional view of the electrical connectors taken at a position other than that of FIG. 1.
Figure 4B:
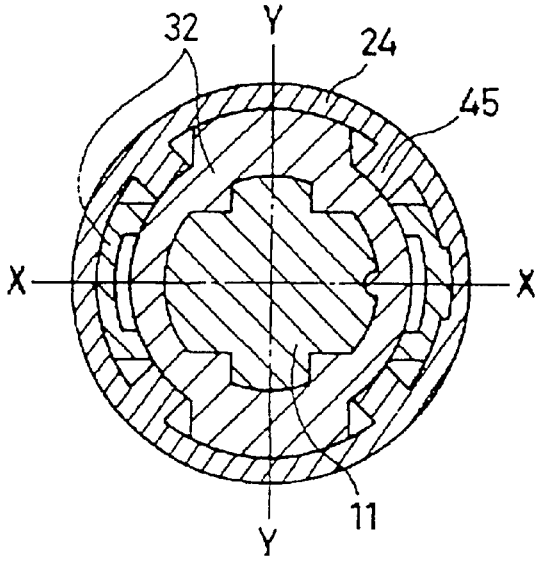
FIG. 4(B) is a sectional view taken along line B—B of FIG. 4(A)
Figure 4C:
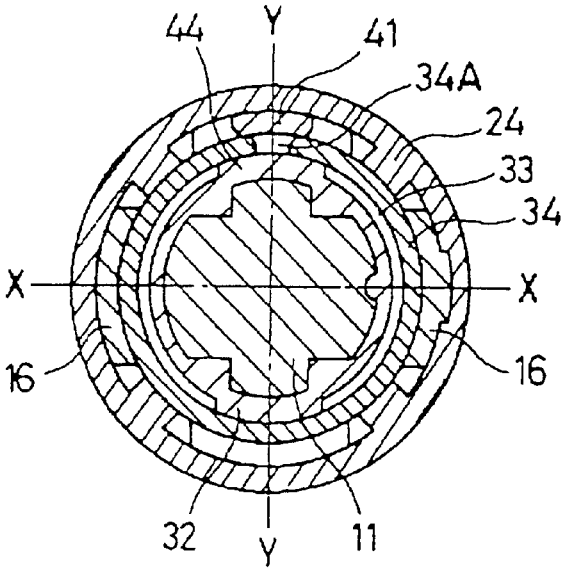
FIG. 4(C) is a sectional view taken along line C—C of FIG. 4(A)
Figure 5:
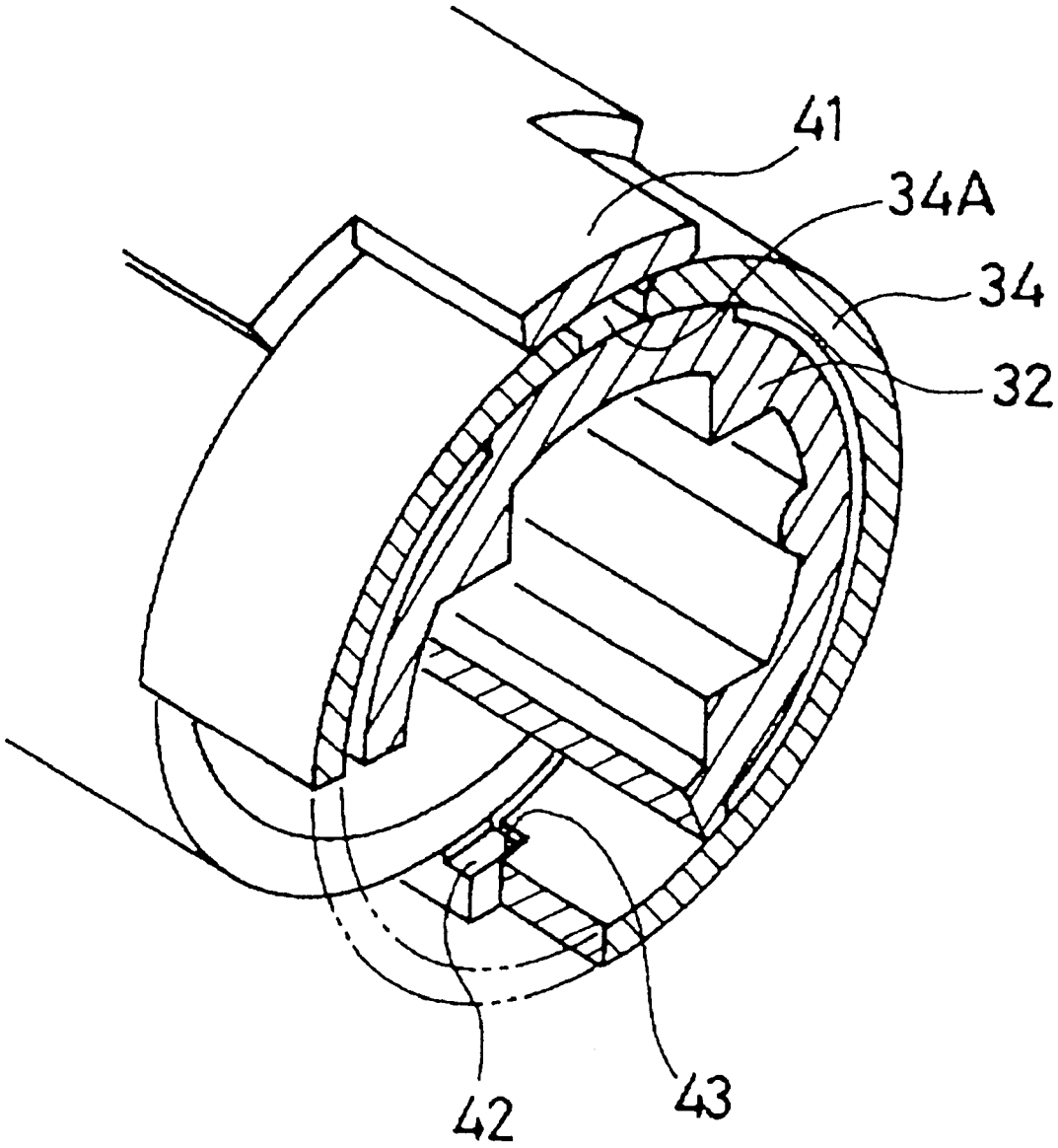
FIG. 5 is a perspective view of one of the electrical connectors taken along line C—C of FIG. 4(A)

FIG. 4(A) is a cross-sectional view of the connectors rotated by 90 degrees relative to the connector of FIG. 1. FIGS. 4(B) and (C) are sectional views taken along lines B—B and C—C of FIG. 4(A), respectively. FIG. 5 is a perspective view of the other connector taken along line B—B of FIG. 4(A). FIGS. 1–3 are sectional views taken along lines X—X of FIGS. 4(B) and (C) and FIG. 4(A) is a sectional view taken long line Y—Y of FIGS. 4(B) and (C). The same or like parts are given like reference numerals throughout the specification.

A regulation piece 41 extends forwardly from the tubular section 32 to the circumferential groove 33. A projecting piece 42 extends forwardly from the tubular section 32 at a position different from the regulation piece 41. It engages with a notch 43 formed on the rear end of the C-shaped ring 34 to prevent the circumferential shift of the C-shaped ring 34. The regulation piece 41 has a width sufficiently large to cover the slit 34A of the C-shaped ring 34 to prevent excessive expansion of the C-shaped ring 34. The number of the regulation and projecting pieces may vary.

A pair of supporting portions 44 are provided on the tubular section 32 to keep the C-shaped ring 34 not only concentric with the circumferential groove 33 but also from moving in the radial direction. The plugging sections of the connectors 10 and 30 have a substantially cross-shaped section and a key portion to prevent any plugging offset in the circumferential direction thereby assuring that the contact elements are arranged in a predetermined relationship.

Figure 6A:
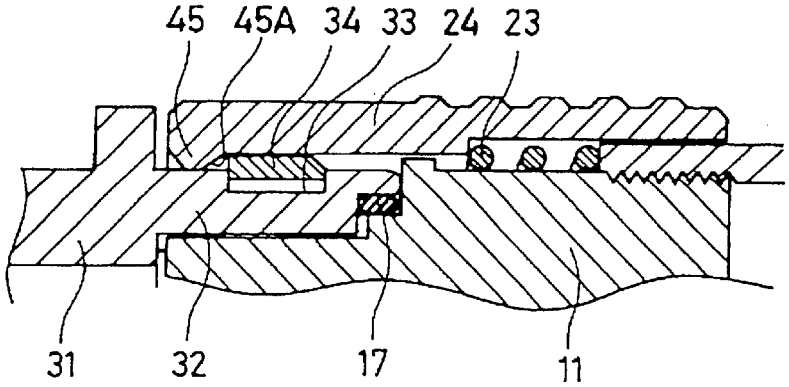
FIGS. 6(A), (B), and (C) are sectional views of the electrical connectors taken at a position other than those of FIGS. 1 and 4(A) at a time of plugging, during separation, and after separation, respectively.

As shown in FIG. 4(B), release projections 45 are provided on the front end inner surface of the sleeve 24 at middle points between lines X—X and Y—Y. As shown in FIG. 6(A), each release projection 45 has a oblique abutting face or tapered face 45A at the rear edge such that the tapered face 45A abuts against the C-shaped ring 34 when the sleeve 24 is moved rearwardly.

The operation of the connectors will be described below.

(1) The plugging is made in the order of FIGS. 2–1–3. When the connector under the condition of FIG. 2 is brought to the condition of FIG. 1 (while the sleeve is not moved), the tapered face 34A of the C-shaped ring 34 abuts against the tapered face 19A of the pressure portion 19 so that the C-shaped ring 34 is compressed and passes the pressure portion 19.

(2) When the C-shaped ring 34 reaches the engaging groove 18 (by this time, the contact elements have been connected), it returns to the original form. Consequently, the C-shaped ring 34 engages with the engaging groove 18 to lock connection of both the connectors 10 and 30. When both the connectors 10 and 30 are connected, the annular projection 32B of the connector 30 presses the O-ring 17 for making seal.

Figure 6B:
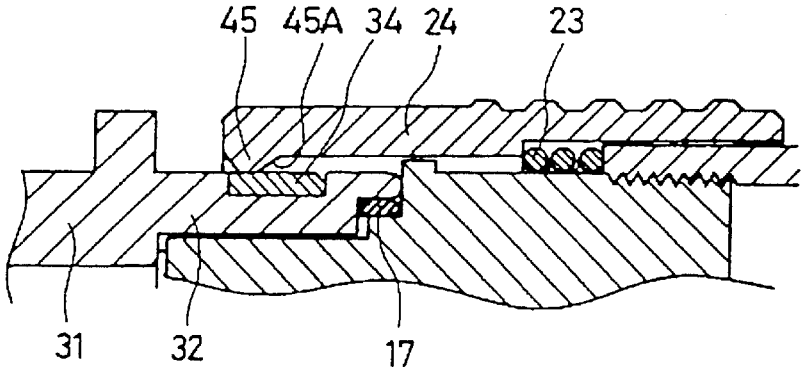
Figure 6C:
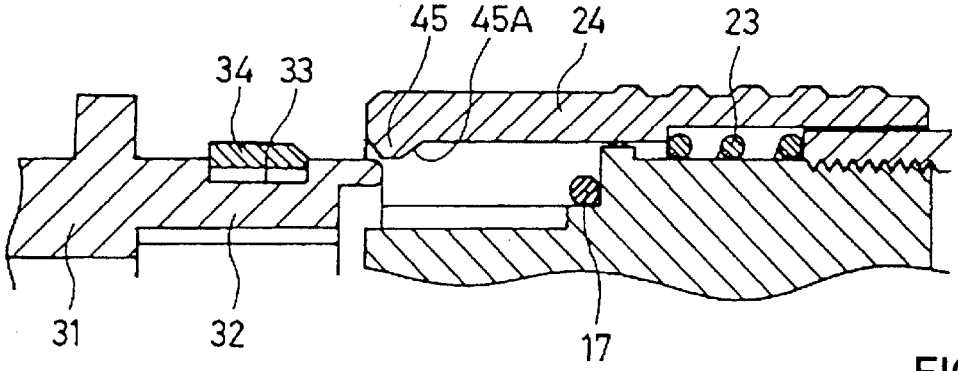

(3) To separate the connectors 10 and 30, as shown in FIG. 6(A), the sleeve 24 of the connector 10 is moved rearwardly against the coil spring 23 so that the tapered face 45A of the sleeve 24 is on the C-shaped ring 34 and compresses it. See FIG. 6(B). Thus, as shown in FIG. 6(C), it is possible to separate the connectors 10 and 30, when the sleeve 24 is returned to the original position by the coil spring 23.

Figure 7:
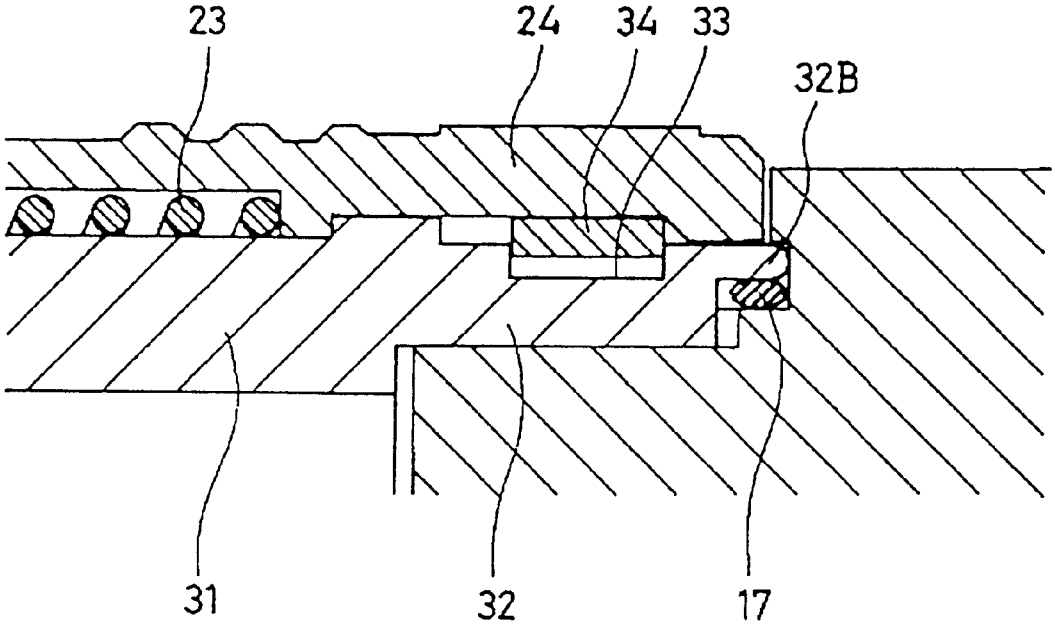
FIG. 7 is a sectional view of a pair of electrical connector according to another embodiment of the invention.
Figure 8:
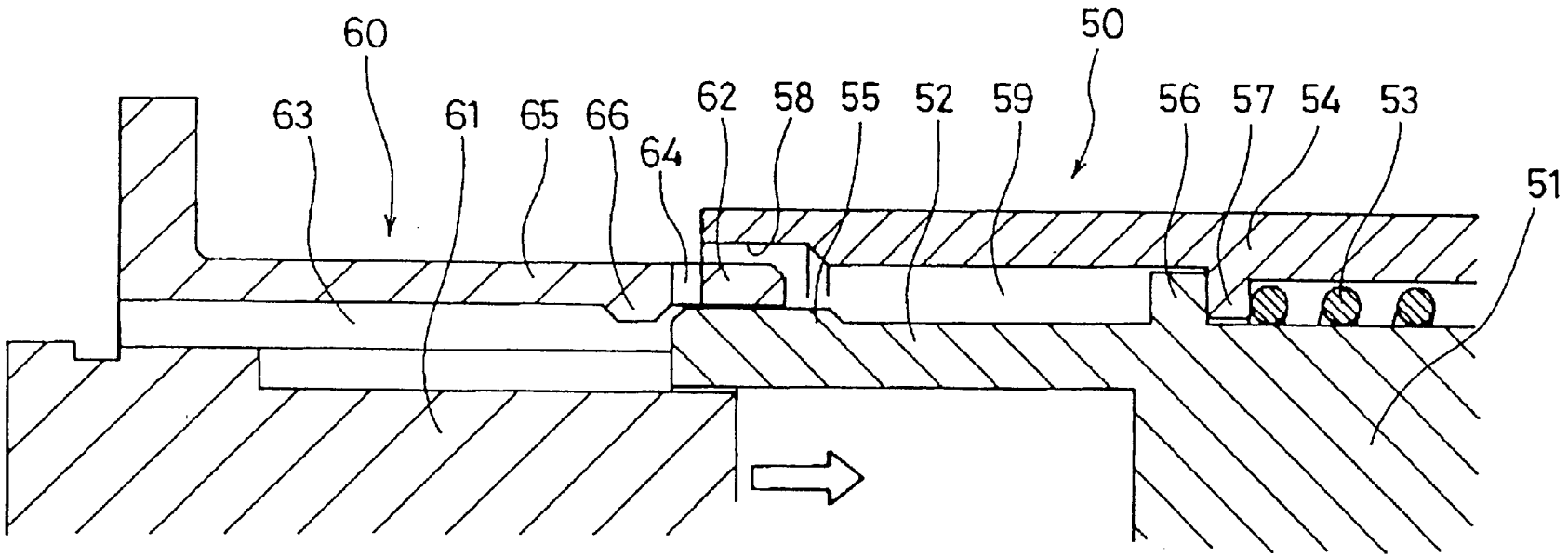
FIG. 8 PRIOR ART
FIG. 8 is a sectional view of conventional electrical connectors.

The sleeve may be provided on either of the connectors. In FIG. 7, the sleeve is provided on the connector 30. The C-shaped ring may be any resiliently expandable member. For example, cantilevered members extend from the connector in the circumferential direction so that the free ends are able to expand in the circumferential direction.

As has been described above, according to the invention, both the connectors are engaged with each other via the resiliently expandable member so that the connectors is made shorter and finer and more compact. The plugging operation of the connectors has no influence on the sleeve for release so that the sleeve can be held to make the plugging operation, making the work easy.

What is claimed is:

1. An electrical connector system comprising:

a first connector comprising a first housing having a front tubular receiving section;

a second connector comprising a second housing having a front tubular fitting section for fitting into said receiving section;

engaging means for ongaging said fitting section with said receiving section; and releasing means for releasing said engaging means; wherein said engaging means comprising:

a circumferential groove provided in said fitting section of said second connector;

a resiliently expandable member provided on said circumferential groove;

a pressure portion provided on a front inside of said receiving section of said first connector for abutment with said first resiliently expandable member;

an engaging groove provided in said receiving section of said first connector for engagement with said resiliently expandable member; and said release means comprising:

a spring;

a sleeve biased by said spring for sliding along either said receiving section or said fitting section;

a plurality of release projections provided on an inside front end of said sleeve; and a plurality of tapered faces provided on either or both of said release projections and said resiliently expandable member at a plurality of positions corresponding to said release projections and said resilient expandable member to abut with edges of said release projections and said resilient expandable member for permitting said release projections to ride on said resiliently expandable member when said sleeve is moved rearwardly.

2. An electrical connector according to claim 1, wherein said second connector further comprises a regulation piece extending to said circumferential groove for preventing excessive expansion of said resiliently expandable member.

3. An electrical connector according to claim 1, wherein said resiliently expandable member is a C-shaped ring having a slit at a position in said circular direction.

4. An electrical connector according to claim 2, which further comprises a projecting piece for engagement with a notch of said C-shaped ring.

* * * * *